US007845382B1

(12) United States Patent
Melino, Sr. et al.

(10) Patent No.: US 7,845,382 B1
(45) Date of Patent: Dec. 7, 2010

(54) ADJUSTABLE DISPENSER FOR PROTECTIVE ADHESIVE FILM

(76) Inventors: Charles E. Melino, Sr., 303 Norwood Ave., Providence, RI (US) 02905; Charles Melino, Jr., 490 Wellington Ave., Cranston, RI (US) 02910

( * ) Notice: Subject to any disclaimer, the term of this patent is extended or adjusted under 35 U.S.C. 154(b) by 230 days.

(21) Appl. No.: 12/002,293

(22) Filed: Dec. 14, 2007

Related U.S. Application Data

(60) Provisional application No. 60/869,956, filed on Dec. 14, 2006.

(51) Int. Cl.
*B65B 41/16* (2006.01)

(52) U.S. Cl. ..... 156/577; 156/574; 156/579

(58) Field of Classification Search ..... 156/574, 156/577, 579
See application file for complete search history.

(56) References Cited

U.S. PATENT DOCUMENTS 3,773,143 A * 11/1973 Del Prete et al. ..... 182/214
4,394,887 A * 7/1983 Spinks ..... 182/214
4,460,433 A * 7/1984 Boyd ..... 156/577
5,159,769 A * 11/1992 Odorisio ..... 37/278
6,158,192 A * 12/2000 Gardner ..... 156/577
6,883,292 B1 * 4/2005 Chen ..... 53/389.1
2005/0028941 A1 * 2/2005 Flowers ..... 156/579
* cited by examiner

*Primary Examiner*—Kat Wyrozebski
*Assistant Examiner*—John Blades
(74) *Attorney, Agent, or Firm*—Steven N. Fox, Esq.

(57) ABSTRACT

The present invention is a device for dispensing rolls of protective adhesive film having different widths. In one embodiment, the device comprises a central support assembly comprising first and second elongated members having a first longitudinal axis and a second longitudinal axis, respectively. The first longitudinal axis of the first elongated member is off-set from the second longitudinal axis of the second elongated member. The central support assembly further comprises first and second extension members each having a first portion telescopically engaged with the first and second elongated members, respectively, and a second portion. The device further comprises a right support assembly engaged with the second portion of the first extension member and comprising a film mounting roller adapted to support the first end portion of the roll of film. The device further comprises a left support assembly engaged with the second portion of the second extension member and comprising a film mounting roller adapted to support the second end portion of the roll of film. The device further comprises a handle engaged with the central support assembly. In use, the first and second extension members may be extended or retracted from the first and second elongated members, respectively, to accommodate film roll widths of 24 inches, 30 inches, 36 inches, or 48 inches. At any film width, the handle is centered between the right and left support assembly.

19 Claims, 13 Drawing Sheets

PRIOR ART

PRIOR ART

PRIOR ART

ADJUSTABLE DISPENSER FOR PROTECTIVE ADHESIVE FILM

CROSS-REFERENCE TO RELATED APPLICATIONS

This applications claims priority to U.S. Provisional Application No. 60/869,956 filed on Dec. 14, 2006, now pending, which is hereby incorporated into this specification by reference in its entirety.

BACKGROUND OF THE INVENTION

Adhesive films are often used to protect carpeting and other floor finishes. There is a continuing need for a dispenser to make application of the film faster and easier. The most common roll widths are 24 inches, 30 inches, 36 inches, and 48 inches. Some manufacturers offer a dispenser that accommodates each roll width and others offer a dispenser that accommodates several different widths.

FIG. 1 shows a prior art device 10 that can accommodate several widths of film roll 12. Device 10 has a central support assembly 14, a right support assembly 36, a left support assembly 44, a film pressing tube 52, and a handle 54. Right support assembly 36 has a bracket 38, a film mounting roller 40 adapted to receive one end of film roll 12, and a film pressing roller 42 adapted to receive one end of film pressing tube 52. Left support assembly 44 has a bracket 46, a film mounting roller 48 adapted to receive the opposite end of film roll 12, and a film pressing roller 50 adapted to receive the opposite end of film pressing tube 52. Central support assembly 14 employs an elongated member 16 having a hollow cavity 18 and open end portions 20 and 22. To accommodate several widths of film, central support assembly 14 has first and second extension members 24 and 30. First extension member 24 has an end portion 26 telescopically mounted within hollow cavity 19 thru end portion 20 of elongated member 16 and an end portion 28 welded to bracket 38 of right support assembly 36. Second extension member 30 has an end portion 32 telescopically mounted within hollow cavity 18 thru end portion 22 of elongated member 16 and an end portion 34 welded to bracket 46 of left support assembly 44. One significant problem with device 10 is that it cannot double its width and cannot fit all of the most common film roll widths, namely, 24 inches, 30 inches, 36 inches, and 48 inches.

FIG. 2 shows a prior art device 56 that accommodates film rolls of 24 inches, 30 inches, 36 inches, and 48 inches. Device 56 has a single-cavity elongated member or housing 58 with consecutively smaller extension members or tubes 60 and 62 telescoping from the same side of elongated member 58. One significant problem with device 56 is that handle 54 is not always centered on the dispenser at widths greater than 24 inches thereby making it difficult to control the unit.

Another problem common to devices 10 and 56 lies in the difficulty with loading both film roll 12 and film pressing tube 52 onto the dispenser. FIG. 3 is an exploded view of device 10 showing film mounting rollers 40 and 48, and film pressing rollers 42 and 50. The depth or length of film mounting roller 40 and film pressing roller 42 (and rollers 48 and 50) are approximately the same. Because both rollers 40 and 42 have the same depth or length, the user must maneuver both film roll 12 and film pressing tube 52 into position, while at the same time telescoping the dispenser to the closed position. This creates a clumsy operation for a person working alone, especially with large heavy rolls of film. Quite often the pressing film tube falls off while the person is mounting the film roll.

FIG. 4 shows a set of prior art film pressing rollers 64. In conventional devices, each film width of 24 inches, 30 inches, 36 inches, and 48 inches employs a matching or corresponding film pressing roller 66, 68, 70 and 72.

SUMMARY OF THE INVENTION

One object of the present invention is to provide a dispenser than can accommodate rolls of film haying widths of 24 inches, 30 inches, 36 inches, and 48 inches while always maintaining the handle in the center of the dispenser.

Another object of the present invention is to provide a dispenser than allows the film pressing tube and film roll to be easily and quickly mounted or otherwise changed.

Another object of the present invention is to provide a dispenser than can accommodate rolls of film having widths of 24 inches, 30 inches, 36 inches, and 48 inches, and which can be packaged in a box or container having a maximum dimension less than 48 inches and preferably about 30 inches.

Another object of the present invention is to provide a dispenser than allows a user to easily cut the roll of film with the handle resting on the ground and moveable to keep the film taught during cutting.

The present invention is a device for dispensing rolls of protective adhesive film having different widths. In one embodiment, the device comprises a central support assembly comprising first and second elongated members having a first longitudinal axis and a second longitudinal axis, respectively. The first longitudinal axis of the first elongated member is off-set from the second longitudinal axis of the second elongated member. The central support assembly further comprises first and second extension members each having a first portion telescopically engaged with the first and second elongated members, respectively, and a second portion. The device further comprises a right support assembly engaged with the second portion of the first extension member and comprising a film mounting roller adapted to support the first end portion of the roll of film. The device further comprises a left support assembly engaged with the second portion of the second extension member and comprising a film mounting roller adapted to support the second end portion of the roll of film. The device further comprises a handle engaged with the central support assembly. In use, the first and second extension members may be extended or retracted from the first and second elongated members, respectively, to accommodate film roll widths of 24 inches, 30 inches, 36 inches, or 48 inches. At any film width, the handle is centered between the right and left support assembly.

BRIEF DESCRIPTION OF THE DRAWINGS

The following description of the present invention will be more fully understood with reference to the accompanying drawings, in which.

DESCRIPTION OF THE INVENTION

Figure 1:
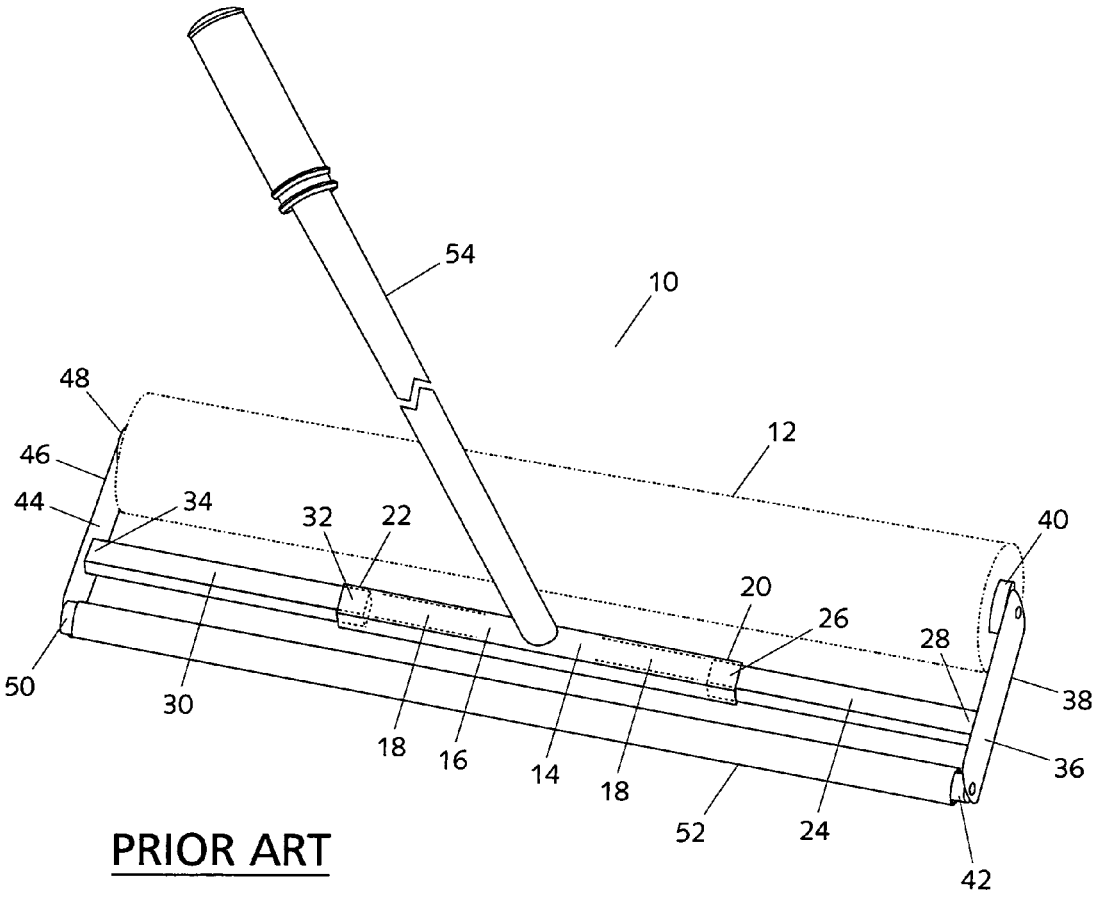
FIG. 1 is perspective view of a first prior art device.
Figure 2:
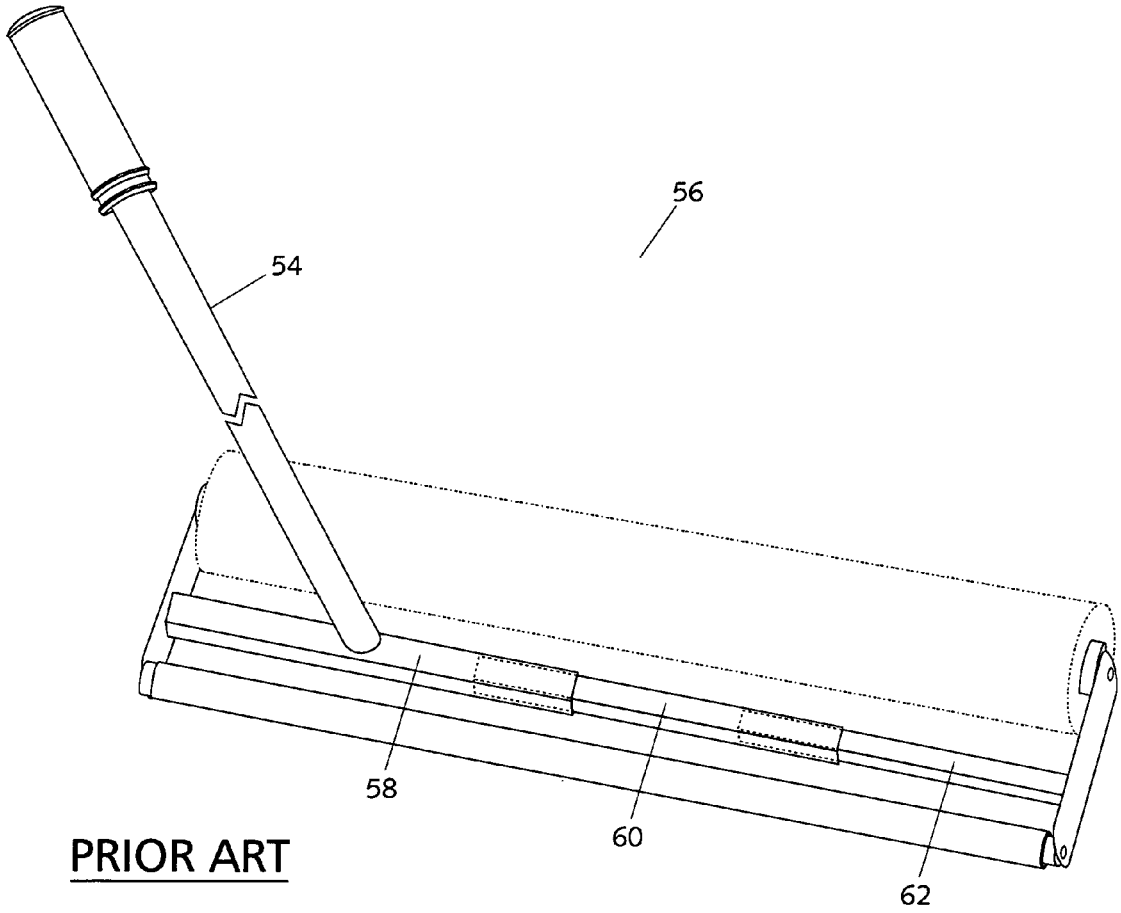
FIG. 2 is a perspective view of a second prior art device.
Figure 3:
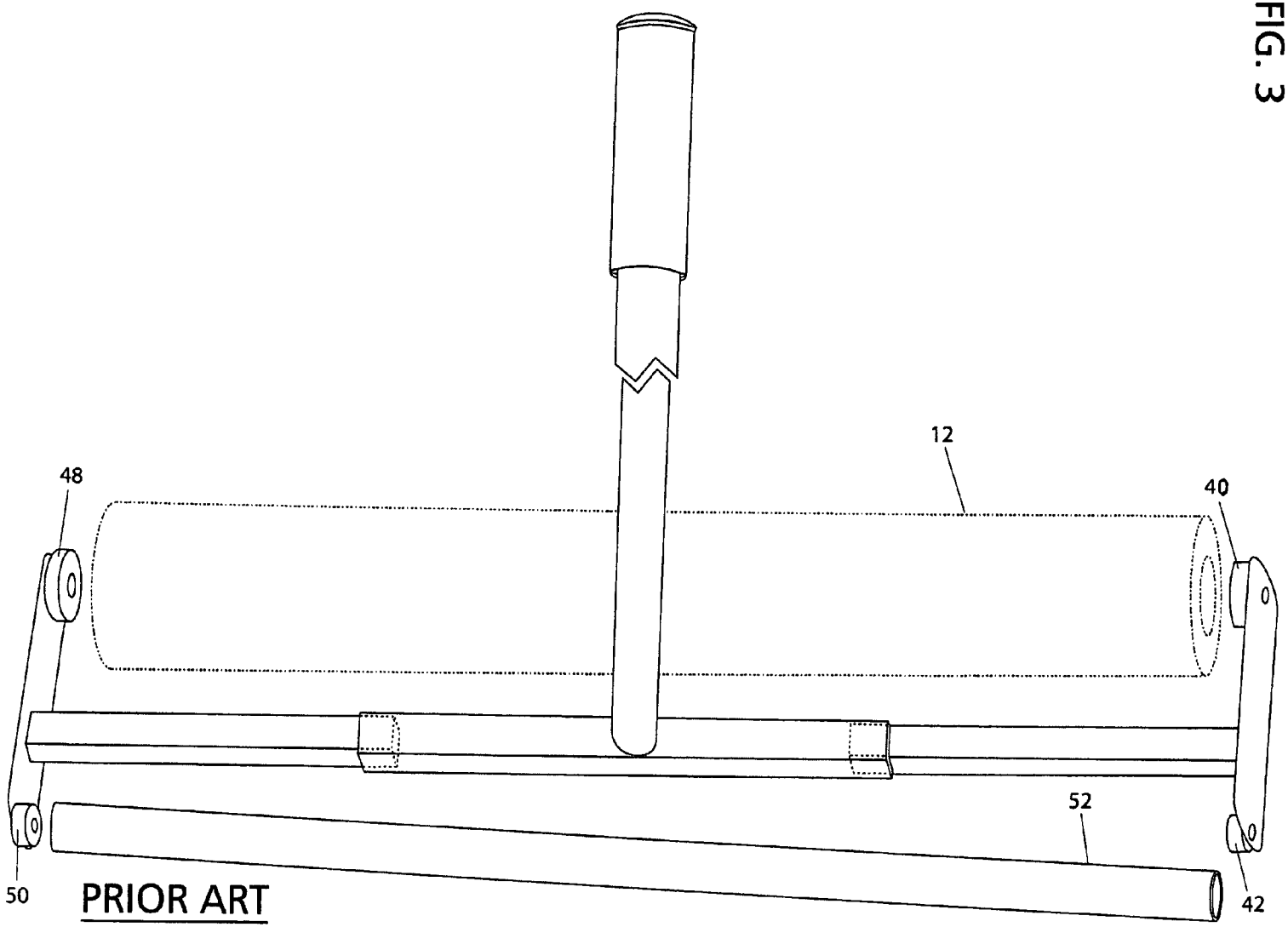
FIG. 3 is an exploded perspective view of the prior art device of FIG. 1.
Figure 4:
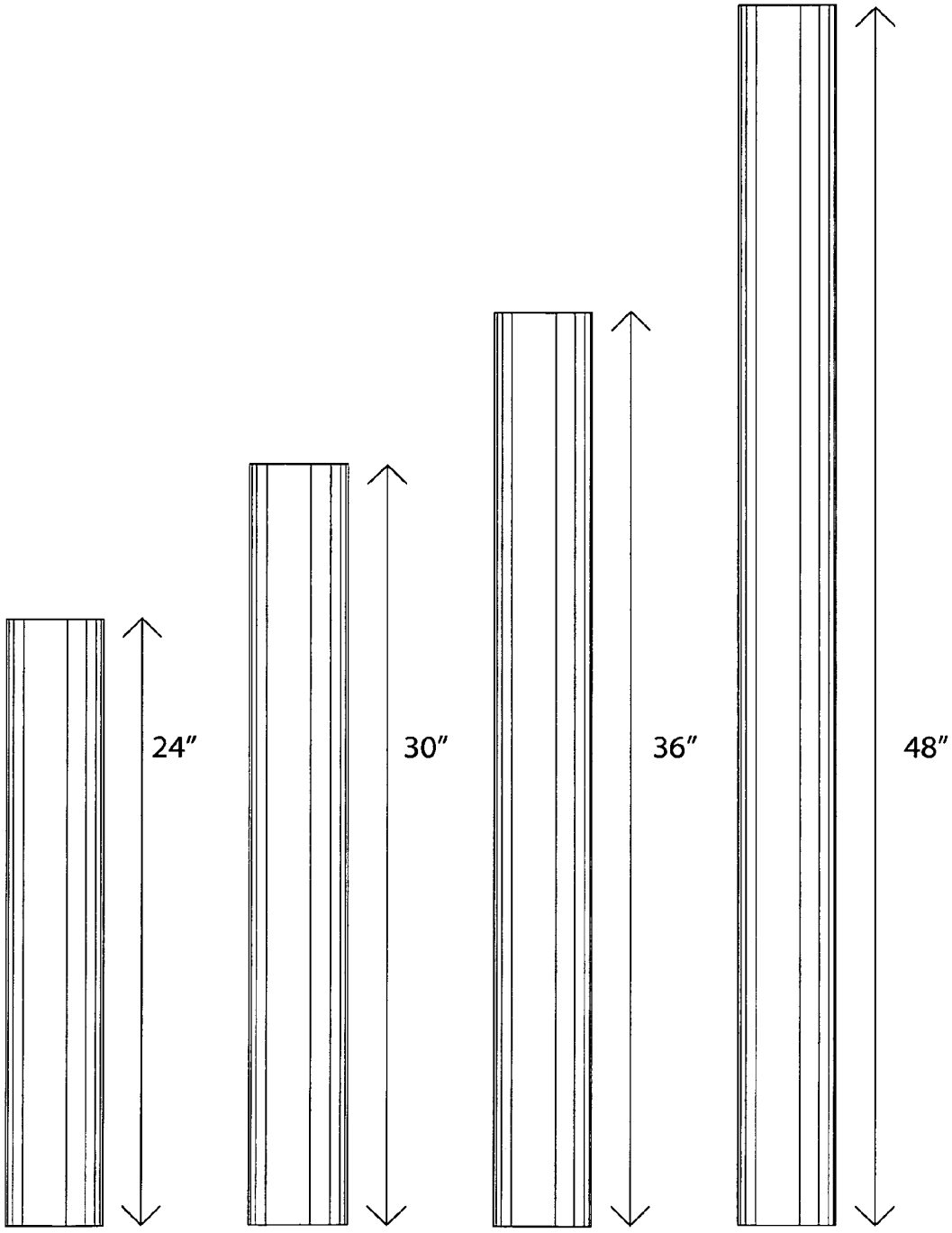
FIG. 4 is a view showing a set of prior art film pressing rollers.
Figure 5:
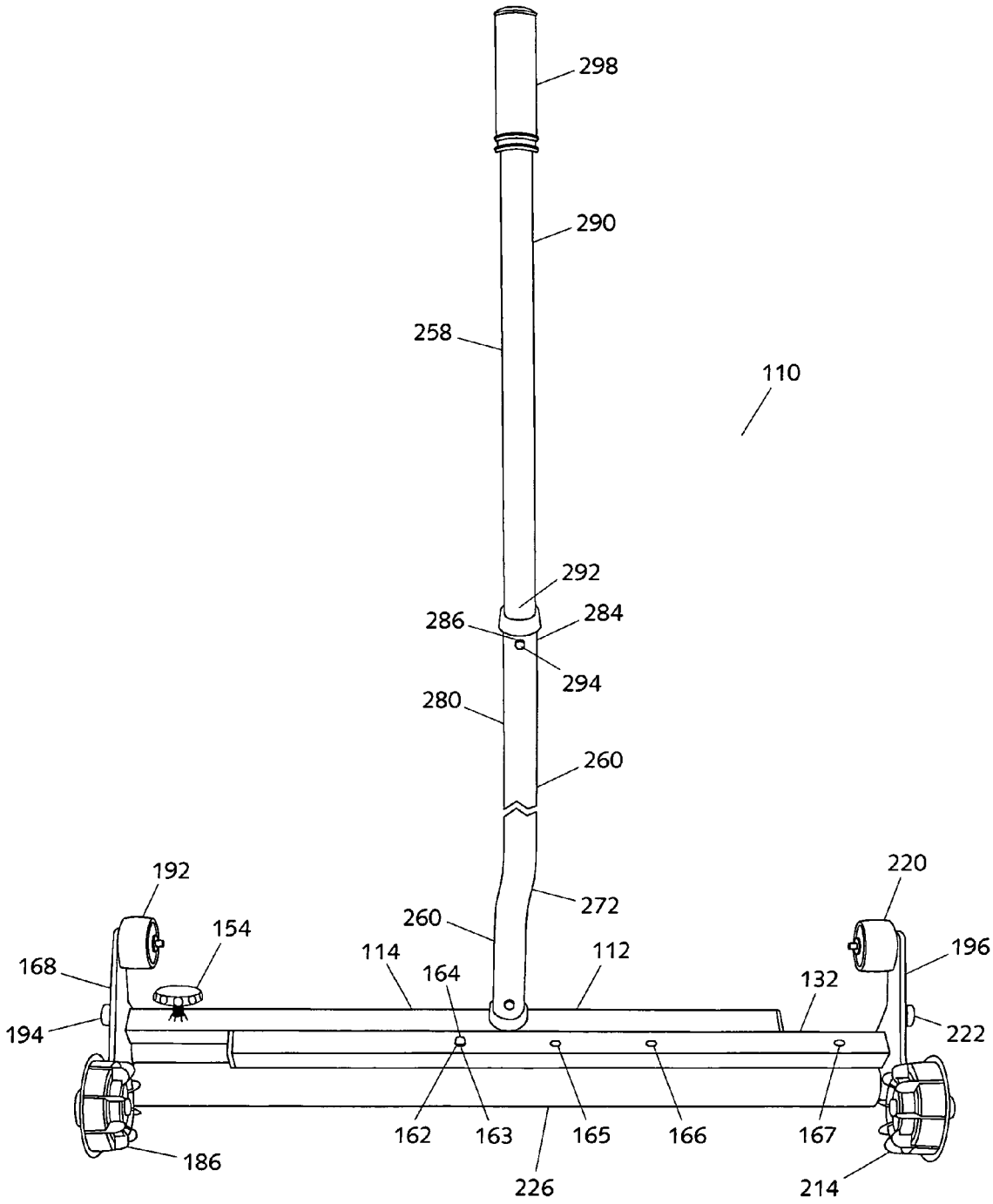
FIG. 5 is a front perspective view of the device according to the present invention.
Figure 6:
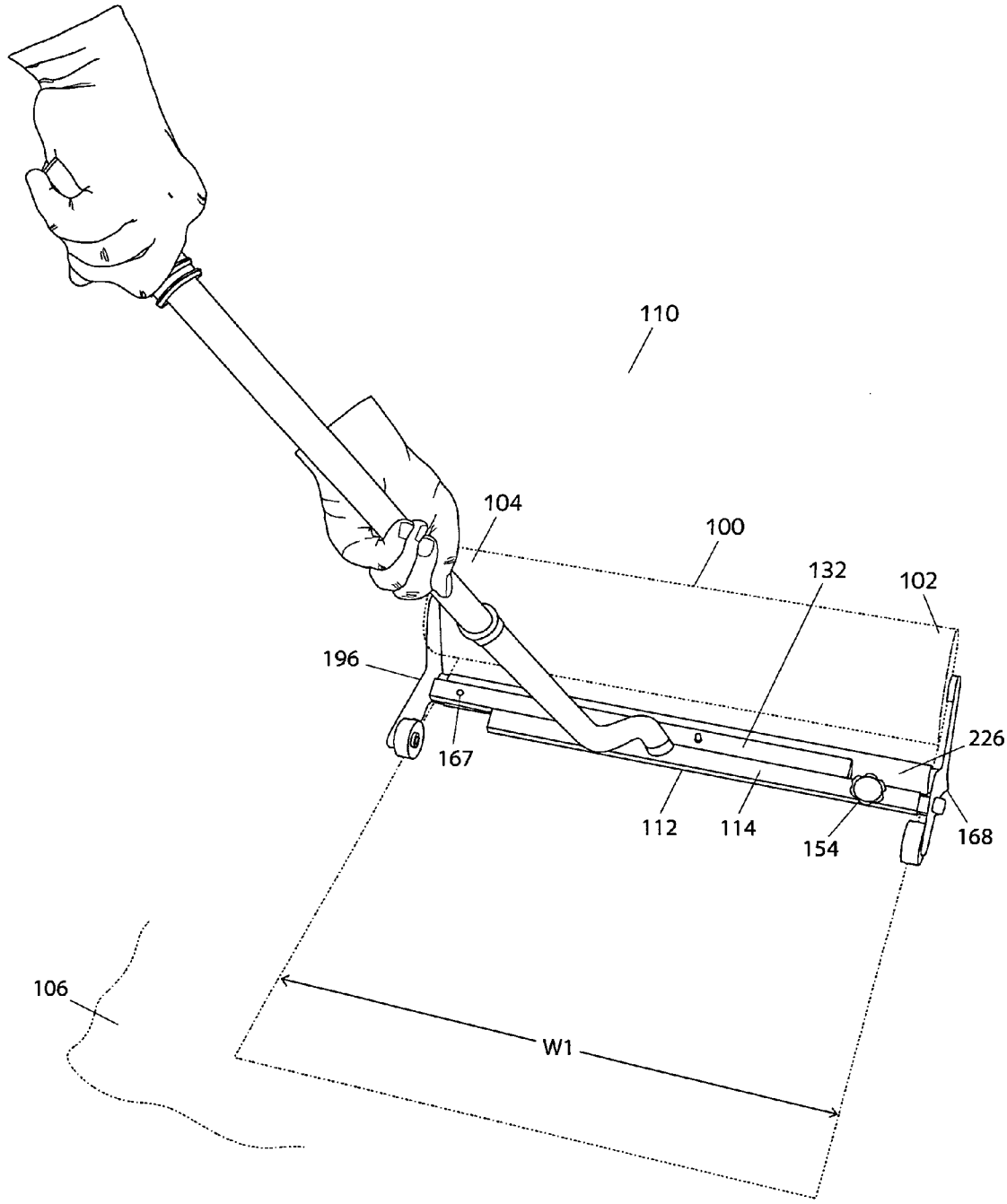
FIG. 6 is a rear perspective view of the device according to the present invention shown mounted with a roll of adhesive film having a width of 24 inches.
Figure 7:
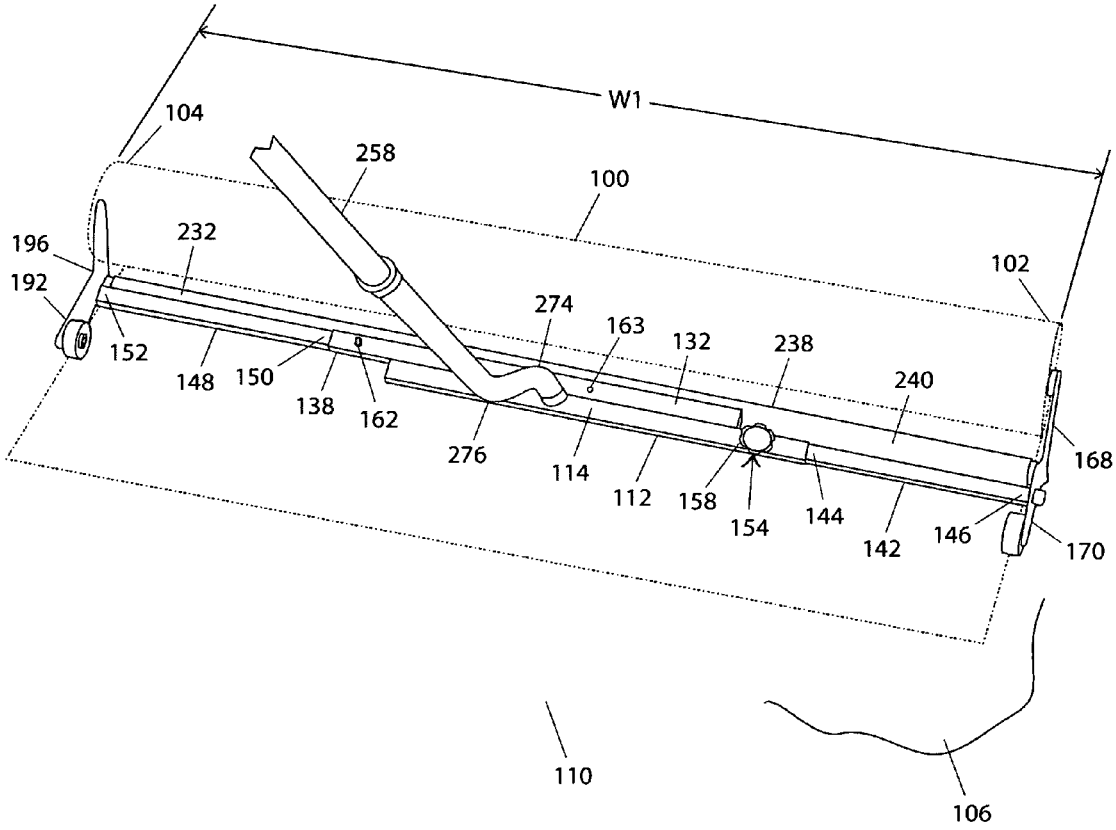
FIG. 7 is a rear perspective view of the device according to the present invention shown mounted with a roll of adhesive film having a width of 48 inches.

Referring to FIGS. 5-7, the present invention is a device 110 for dispensing rolls of protective adhesive film 100 having different widths upon a floor surface 106. Film roll 100 has first and second end portions 102 and 104, and a width W1. As commonly used in the industry, width W1 of film roll 100 is 24 inches, 30 inches, 36 inches or 48 inches.

Device 110 generally comprises a central support assembly 112, a right support assembly 168, a left support assembly 196, a pressing tube kit 224 (FIG. 11), and a handle 258. FIGS. 5 and 6 show the device 110 fully retracted for dispensing a roll of film 100 having a width of 24 inches using a first pressing tube 226 (to be described) of pressing tube kit 224. FIG. 7 shows the device 110 fully extended for dispensing a roll of film 100 having a width of 48 inches using second and third pressing tubes 240 (to be described) of pressing tube kit 224.

Figure 12:
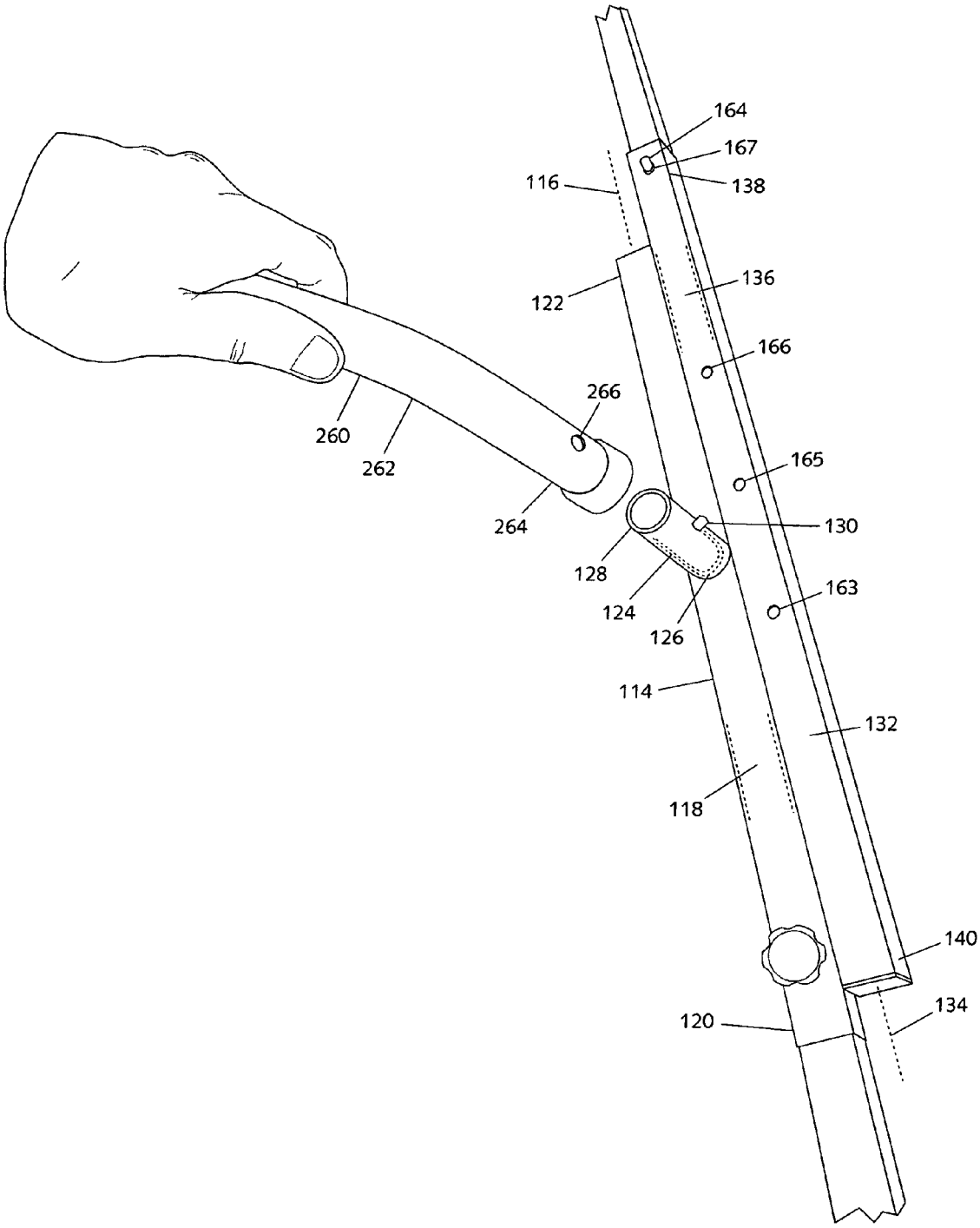
FIG. 12 is a partial perspective view of the device according to the present invention showing the lower member of the handle mounted to a handle mounting member of the central support assembly.

Referring to FIGS. 7 and 12, central support assembly 112 generally comprises a first elongated member 114, a second elongated member 132, a first extension member 142, a second extension member 148, a first fastener mechanism 154, and a second fastener mechanism 162. First elongated member 114 generally comprises a first longitudinal axis 116, a hollow cavity 118, an open end portion 120, a closed end portion 122, and a handle mounting member 124. Handle mounting member 124 comprises a lower end portion 126 and an upper end portion 128 having a spring button 130. As will be described more fully herein, upper end portion 128 of handle mounting member 124 is adapted to removably engage with handle 258. In the embodiment shown, first elongated member 114 is rectangular shaped with a square cross-section. First elongated member 114 may have a variety of other shapes such as tubular with a circular cross-section. In the embodiment shown, first elongated member 114 is made from steel. First elongated member 114 may be made from a variety of other materials such as aluminum or plastic.

With continued reference to FIGS. 7 and 12, second elongated member 132 comprises a second longitudinal axis 134, a hollow cavity 136, an open end portion 138 and a closed end portion 140. First longitudinal axis 116 of first elongated member 114 is off-set from second longitudinal axis 134 of second elongated member 132. In the embodiment shown, second elongated member 132 is secured or fastened to first elongated member 114 by a plurality of welds (not shown). Second elongated member 132 may be secured to first elongated member 114 by a variety of other conventional means such as bolts and nuts. In the embodiment shown, second elongated member 132 is rectangular shaped with a square cross-section. Second elongated member 132 may have other shapes such as tubular with a circular cross-section. In the embodiment shown, second elongated member 132 is made from steel. Second elongated member 132 may be made from a variety of other materials such as aluminum or plastic.

Figure 10:
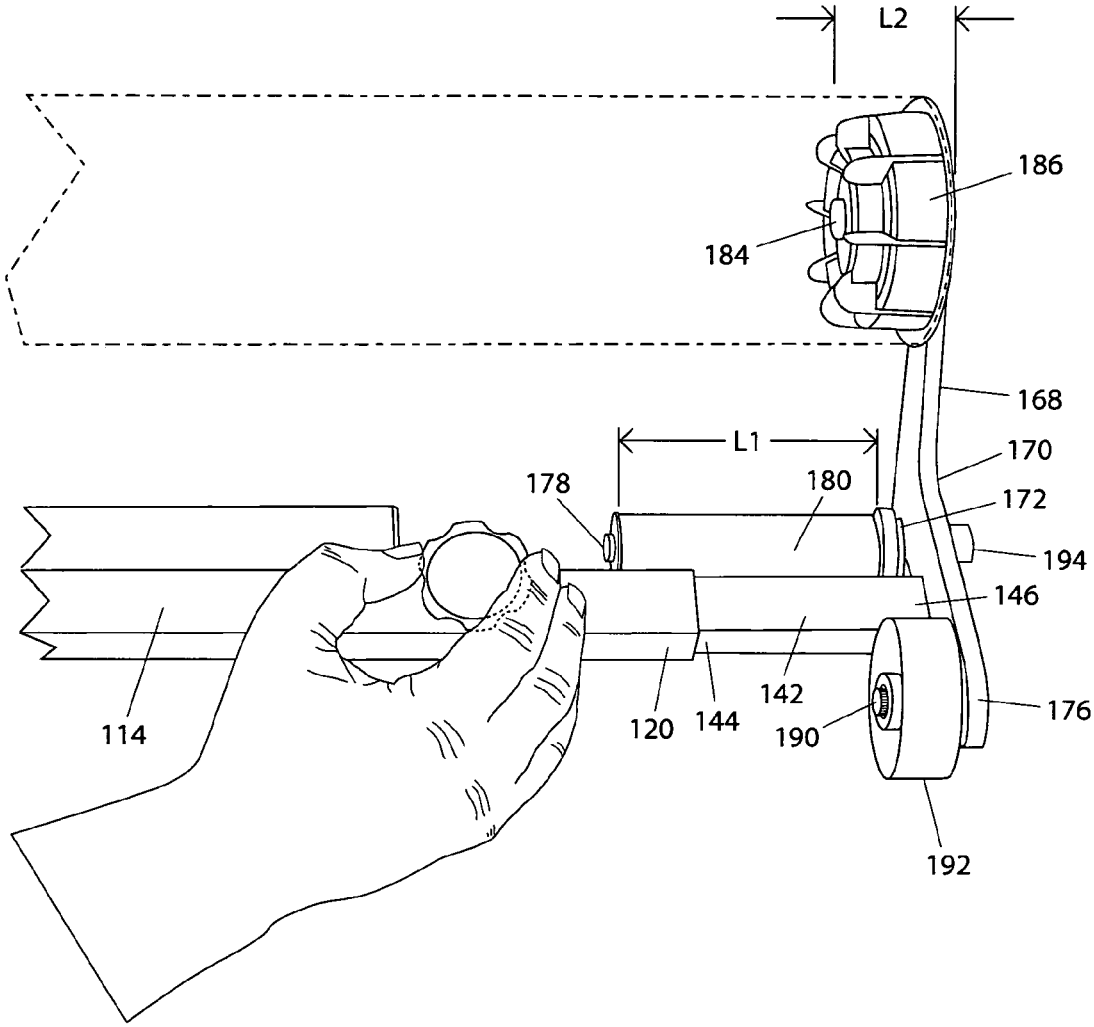
FIG. 10 is a partial perspective view of the device according to the present invention showing the right support assembly with a film mounting roller, a film pressing roller, and a wheel.

Referring to FIGS. 7 and 10, first extension member 142 comprises a first portion 144 telescopically engaged with hollow cavity 118 and open end portion 120 of first elongated member 114 and a second portion 146 securely engaged with a bracket 170 (to be described) of right support assembly 168. In the embodiment shown, first extension member 142 is rectangular shaped with a square cross-section. First extension member 142 may have a variety of other shapes such as tubular with a circular cross-section. In the embodiment shown, first extension member 142 is made from steel. First extension member 142 may be made from a variety of other materials such as aluminum or plastic.

Figure 9:
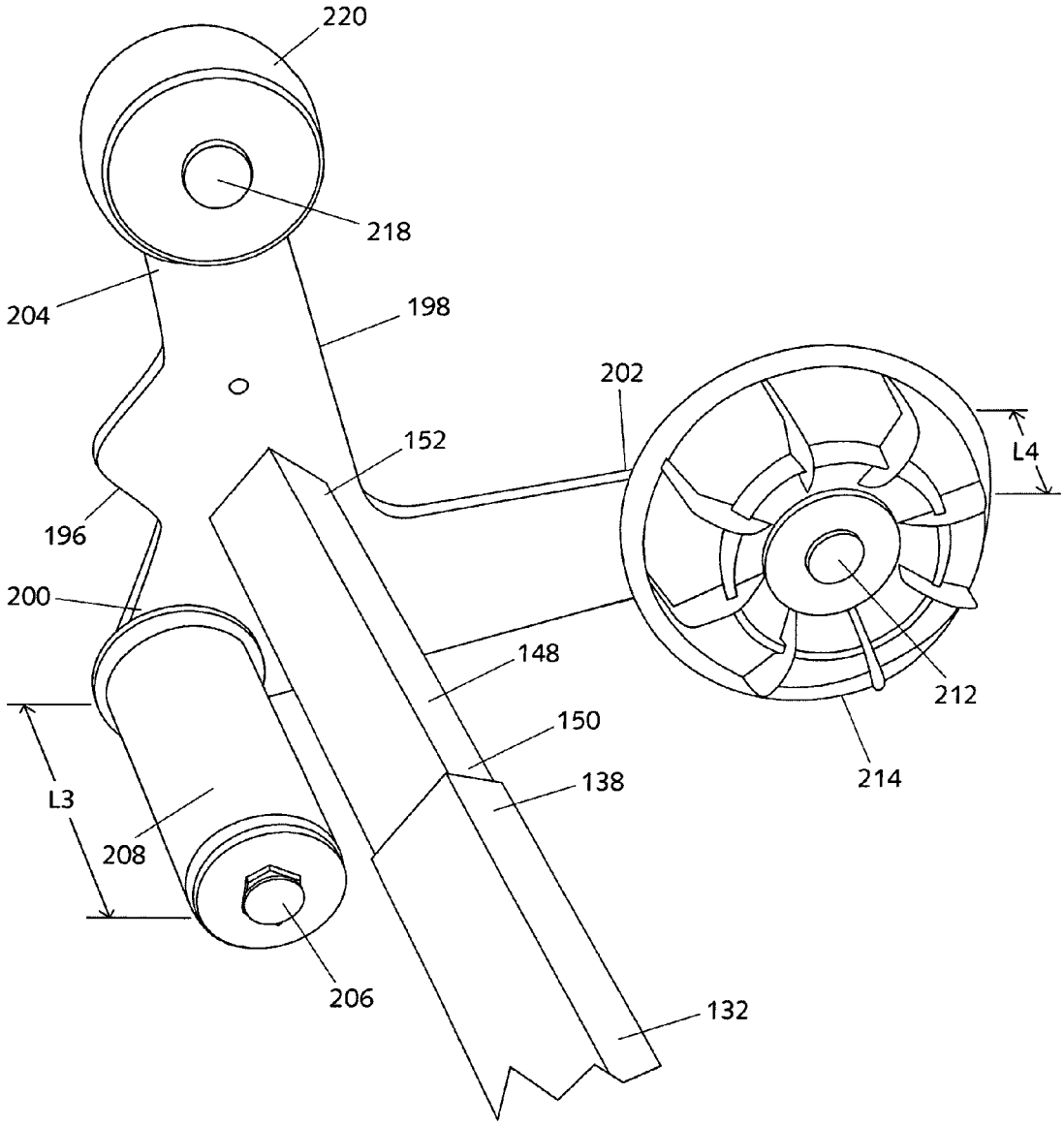
FIG. 9 is a cut-away perspective view of the device according to the present invention showing the left support assembly with a film mounting roller, a film pressing roller, and a wheel.

Referring to FIGS. 7 and 9, second extension member 148 comprises a first portion 150 telescopically engaged with hollow cavity 136 and open end portion 138 of second elongated member 132 and a second portion 152 securely engaged with a bracket 198 (to be described) of left support assembly 196. In the embodiment shown, second extension member 148 is rectangular shaped with a square cross-section. Second extension member 148 may have other shapes such as tubular with a circular cross-section. In the embodiment shown, second extension member 148 is made from steel. Second extension member 148 may be made from a variety of other materials such as aluminum or plastic.

In operation, first and second extension members 142 and 148 may be extended or retracted from first and second elongated members 114 and 132, respectively, to accommodate film roll widths of 24 inches, 30 inches, 36 inches, or 48 inches. At any film width, handle 258 is centered between right support assembly 168 and left support assembly 196.

Figure 8:
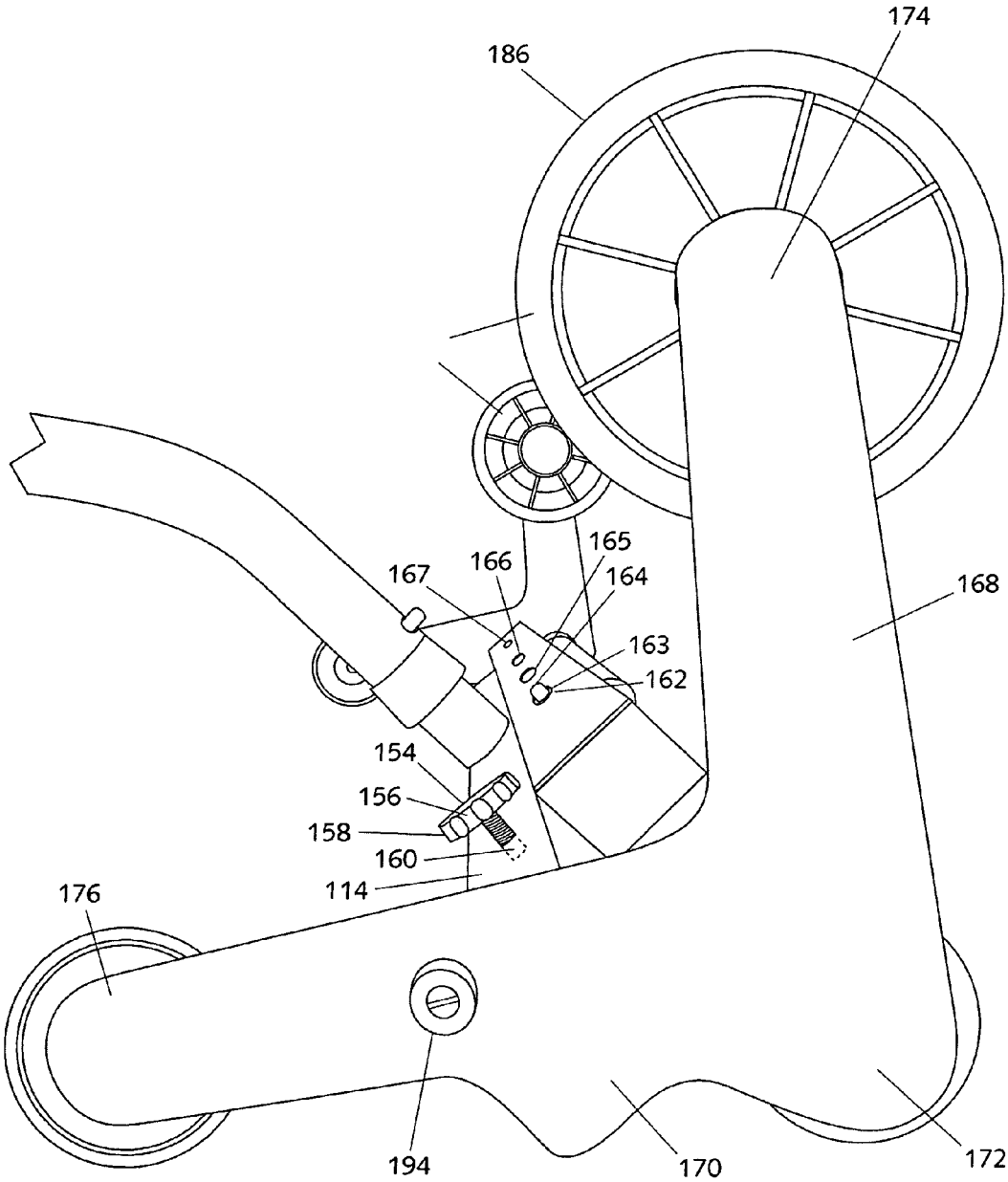
FIG. 8 is a side perspective view of the device according to the present invention.

Referring to FIGS. 7 and 8, first fastener mechanism 154 is provided as a means for securing the position of first extension member 142 relative to first elongated member 114. In the embodiment shown, first fastener mechanism 154 comprises a thumb screw 156 having a knob portion 158 and an end portion 160. Thumb screw 156 is mounted on first elongated member 114. Turning of knob portion 158 causes end portion 160 to engage first extension member 142. First fastener mechanism 154 may take a variety of other designs. By way of example only, first fastener mechanism 154 may comprise a spring button positioned in first extension member 142 and a plurality of spring holes positioned along first elongated member 114.

With continued reference to FIGS. 7 and 8, second fastener mechanism 162 is provided as a means for securing the position of second extension member 148 relative to second, elongated member 132. In the embodiment shown, second fastener mechanism 162 comprises a spring button 164 disposed in second extension member 148 and a plurality of spring holes 163, 165, 166, and 167 disposed along second elongated member 132. Depression of spring button 164 allows second extension member 148 to be extended or retracted until spring button 164 is positioned below the next adjacent spring hole 166 where second extension member 148 and second elongated member 132 become locked into position. Subsequent depression of spring button 164 allows the second extension member 148 to be further extended or retracted relative to second elongated member 132 until the desired position is obtained. In the embodiment shown, spring holes 163, 165, 166, and 167 are positioned and spaced along second elongated member 132 to obtain widths of 24 inches, 30 inches, 36 inches, and 48 inches while always having the handle 258 centered between right support assembly 168 and left support assembly 196. Spring hole 163 is used with a film roll width of 24 inches. Spring hole 165 is used with a film roll width of 30 inches. Spring hole 166 is used with a film roll width of 36 inches. Spring hole 167 is used with a film roll width of 48 inches. Second fastener mechanism 162 may take a variety of other designs. By way of example only, second fastener mechanism 162 may comprise a thumb screw positioned in second elongated member 132. Turning of the knob portion of the thumb screw would cause an end portion of the thumb screw to engage second extension member 148. Use of spring button 164 and spring holes 163, 165, and 167 are preferred to make it easy for the user to properly position second extension member 148 relative to second elongated member 132 to obtain widths of 24 inches, 30 inches, 36 inches, or 48 inches while always ensuring that handle 258 is centered.

Referring to FIGS. 8 and 10, right support assembly 168 comprises a bracket 170. Bracket 170 is boomerang shaped and comprises first, second and third mounting portions 172, 174, and 176. In the embodiment shown, bracket 170 is made from steel. Right support assembly 168 further comprises a film pressing roller axel 178 secured to first mounting portion 172 of bracket 170. Axel 178 is a solid cylindrical shaft welded to first mounting portion 172. Right support assembly 168 further comprises a film pressing roller 180 mounted to and freely rotatable about axel 178 by conventional fasteners. Film pressing roller 180 has a depth or length L1. As known in the industry, film pressing roller 180 may be made of PVC plastic. Right support assembly 168 further comprises a film mounting roller axel 184 secured to second mounting portion 174 of bracket 170. Axel 184 is a solid cylindrical shaft welded to second mounting portion 174. Right support assembly 168 further comprises a film mounting roller 186 mounted to and freely rotatable about axel 184 by conventional fasteners. Film mounting roller 186 has a length L2. Film mounting roller 186 is well known and widely available. As will be described more fully herein, length L1 of film pressing roller is longer than length L2 of film mounting roller 186 so that film roll 110 can be easily mounted without the film pressing tube falling off. Right support assembly 168 further comprises a wheel axel 190 secured to third mounting portion 176 of bracket 170. Axel 190 is a solid cylindrical shaft welded to third mounting portion 176. Right support assembly 168 further comprises a rubber or plastic wheel 192 mounted to and freely rotatable about axel 190 by conventional fasteners. Wheel 192 is well known and widely available. Right support assembly 168 further comprises a rubber bumper 194 secured to the outside of bracket 170 by conventional means such as a nut and bolt. Bumper 194 is provided to prevent the device 110 from damaging walls during use.

Referring to FIG. 9, left support assembly 196 comprises a bracket 198. Bracket 198 is boomerang shaped and comprises first, second and third mounting portions 200, 202, and 204. In the embodiment shown, bracket 198 is made from steel. Left support assembly 196 further comprises a film pressing roller axel 206 secured to first mounting portion 200 of bracket 198. Axel 206 is a solid cylindrical shaft welded to first mounting portion 200. Left support assembly 196 further comprises a film pressing roller 208 mounted to and freely rotatable about axel 206 by conventional fasteners. Film pressing roller 208 has a depth or length L3. As known in the industry, film pressing roller 208 may be made of PVC plastic. Left support assembly 196 further comprises a film mounting roller axel 212 secured to second mounting portion 202 of bracket 198. Axel 212 is a solid cylindrical shaft welded to second mounting portion 202. Left support assembly 196 further comprises a film mounting roller 214 mounted to and freely rotatable about axel 212 by conventional fasteners. Film mounting roller 214 has a depth or length L4. Film mounting roller 214 is well known and widely available. As will be described more fully herein, length L3 of film pressing roller 208 is longer than length L4 of film mounting roller 214 so that film roll 110 can be easily mounted without the film pressing tube falling off. Left support assembly 196 further comprises a wheel axel 218 secured to third mounting portion 204 of bracket 198. Axel 218 is a solid cylindrical shaft welded to third mounting portion 204. Left support assembly 196 further comprises a rubber or plastic wheel 220 mounted to and freely rotatable about axel 218 by conventional fasteners. Wheel 220 is well known and widely available. As best shown by FIG. 5, left support assembly 196 further comprises a rubber bumper 222 secured to the outside of bracket 198 by conventional means such as a nut and bolt. Bumper 222 is provided to prevent device 110 from damaging walls during use.

Length L1 of film pressing roller 180 is larger than length L2 of film mounting roller 186. In the embodiment shown, length L1 of film pressing roller 180 is at least one-half (0.50) inches longer than length L2 of film mounting roller 186, and preferably two (2) inches longer. Similarly, length L3 of film pressing roller 208 is longer than length L4 of film mounting roller 214. In the embodiment shown, length L3 of film pressing roller 208 is at least one-half (0.50) inches longer than length L4 of film mounting roller 214, and preferably two (2) inches longer. Because film pressing rollers 180 and 208 have lengths L1 and L3, respectively, that are longer than lengths L2 and L4 of film mounting rollers 186 and 214, respectively, film roll 110 can be easily mounted by the user without the film pressing tube falling off. In the embodiment shown, both film pressing rollers 180 and 208 have lengths L1 and L3, respectively, that are longer than lengths L2 and L4 of film mounting rollers 186 and 214, respectively. Although less desirable, only one of film pressing rollers 180 and 208 needs to have a smaller length than film mounting rollers 186 and 214.

Figure 11:
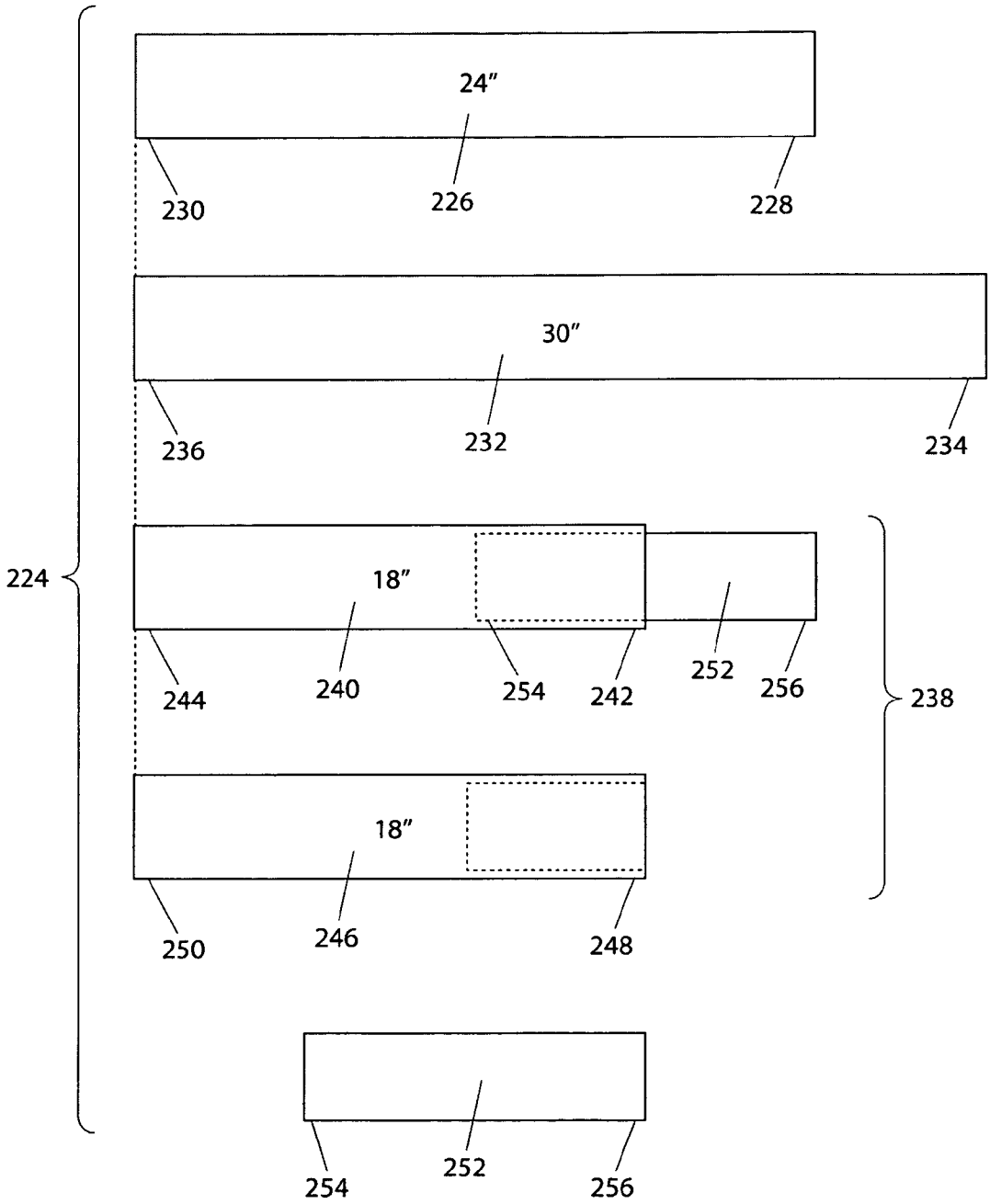
FIG. 11 is a view of a pressing tube set according to the present invention.

Referring to FIG. 11, pressing tube kit 224 comprises a first pressing tube 226 and a second pressing tube 232. First and second pressing tubes 226 and 232 have a length of 24 inches and 30 inches, respectively. First pressing tube 226 has a first end portion 228 and a second end portion 230. Second pressing tube 232 has a first end portion 234 and a second end portion 236. Pressing tube kit 224 further comprises a pressing tube assembly 238. Pressing tube assembly 238 comprises a third pressing tube 240 having a length of 18 inches. Third pressing tube 240 has a first end portion 242 and a second end portion 244. Pressing tube assembly 238 further comprises a fourth pressing tube 246 having a length of 18 inches. Fourth pressing tube 246 has a first end portion 248 and a second end portion 250. Pressing tube assembly 238 further comprises an interconnect tube 252 having a first end portion 254 securely engaged with first portion 242 of third pressing tube 240, and a second end portion 256. In use, fourth pressing tube 246 may be removably engaged with second end portion 256 of interconnect tube 252 to provide a spliced film pressing tube having a length of 36 inches. Alternatively, second pressing tube 232 may be removably engaged with second end portion 256 of third pressing tube 240 to provide a spliced film pressing tube having a length of 48 inches. Unlike conventional devices or systems, pressing tube kit 224 may be used to provide film pressing tubes having lengths of 24 inches, 30 inches, 36 inches, and 48 inches while requiring a maximum packaging dimension of about 30 inches thereby reducing the size of the shipping box or container.

Figure 13:
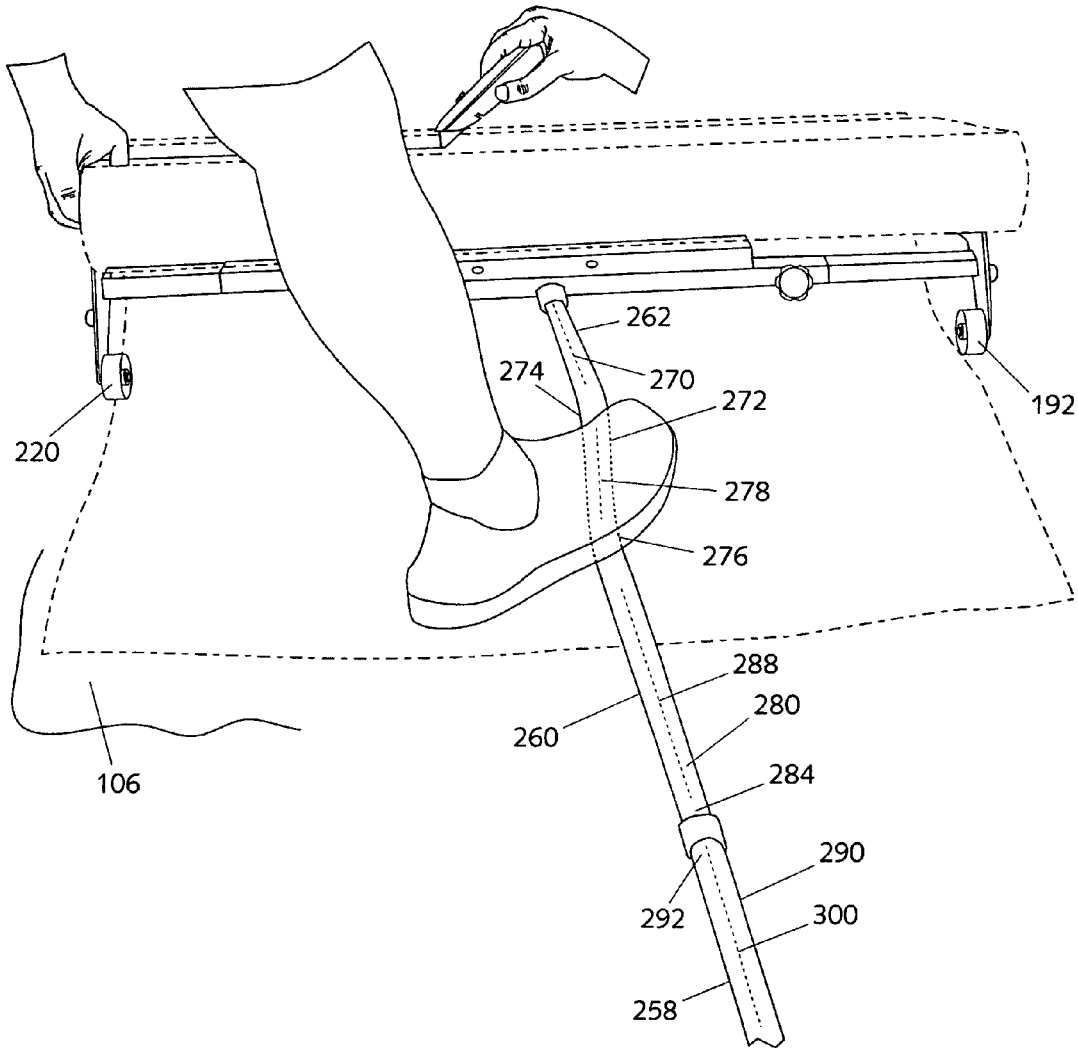
FIG. 13 is a partial perspective view of the device according to the present invention showing the handle resting on the ground or floor surface and the film elevated and supported by the wheels so that person may push the dispenser forward to keep the film taut during cutting.

Referring to FIGS. 5, 12, and 13, handle 258 comprises a lower member 260 and an upper member 290. Lower member 260 is removably engaged with handle mounting member 124 of first elongated member 114. Lower member 260 comprises a lower portion 262, an intermediate portion 272, and an upper portion 280. As best shown by FIG. 12, lower portion 262 comprises an end portion 264. A spring button hole 266 is provided in lower end portion 264 adapted to engage with spring button 130 of upper end portion 128 of handle mounting member 124. Lower portion 262 is defined by a longitudinal axis 270. Upper portion 280 comprises a longitudinal axis 288 and an end portion 284. A spring button hole 286 is provided in end portion 284 of upper portion 280. Intermediate portion 272 comprises bends 274 and 276 and a longitudinal axis 278. Upper member 290 comprises an end portion 292 having a spring button 294 adapted to removably engage with spring button hole 286 of end portion 284 of lower member 260. Upper member 290 has a rubber grip 298 so that a user may firmly grasp handle 258. Upper member 290 is defined by a longitudinal axis 300. Bends 274 and 276 are provided so that longitudinal axis 278 of intermediate portion 272 is off-set from longitudinal axis 270 of lower portion 262 and longitudinal axis 288 of upper portion 280 thereby allowing upper portion 280 of lower member 260 and upper member 290 to rest substantially flat on floor surface 106 with wheels 192 and 220 bearing the weight of device 110. In this orientation, film roll 100 is raised off the surface 106 and may be cut by the user. The user's foot may be placed on intermediate portion 272 to push the device 110 as needed to keep the film roll 100 taught during cutting.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed:

1. A device for dispensing rolls of film having first and second end portions and film roll widths of 24 inches, 30 inches, 36 inches, and 48 inches, the device comprising:

(a) a central support assembly comprising first and second elongated members having a first longitudinal axis and a second longitudinal axis, respectively; said first longitudinal axis of said first elongated member is off-set from said second longitudinal axis of said second elongated member; said central support assembly further comprising first and second extension members each having a first portion engaged with said first and second elongated members, respectively, and a second portion;

(b) a right support assembly engaged with said second portion of said first extension member; said right support assembly comprising a film mounting roiling adapted to support the first end portion of the rolls of film;

(c) a left support assembly engaged with said second portion of said second extension member; said left support assembly comprising a film mounting rolling adapted to support the second end portion of the rolls of film;

(d) a handle engaged with said central support assembly; and (e) whereby said first and second extension members may be moved relative to said first and second elongated members, respectively, to accommodate the film roll widths of 24 inches, 30 inches, 36 inches, and 48 inches, and at any of the film widths, said handle may be centered between said right support assembly and said left support assembly.

2. The device of claim 1, wherein each of said first and second elongated members have a hollow cavity and an open end portion.

3. The device of claim 2, wherein said first portion of said first extension member is telescopically engaged with said hollow cavity of said first elongated member.

4. The device of claim 3, wherein said first portion of said second extension member is telescopically engaged with said hollow cavity of said second elongated member.

5. The device of claim 4, wherein said central support assembly further comprises a first fastener mechanism operable between a first position where said first extension member is moveable relative to said first elongated member and a second position where said first extension member is fixed relative to said first elongated member.

6. The device of claim 5, wherein said central support assembly further comprises a second fastener mechanism operable between a first position where said second extension member is moveable relative to said second elongated member and a second position where said second extension member is fixed relative to said second elongated member.

7. The device of claim 6, wherein said second fastener mechanism comprises a plurality of spring button holes disposed in said second elongated member and a spring button disposed in said second extension member adapted to engage one of said spring button holes.

8. The device of claim 7, wherein said plurality of spring button holes comprises a first spring button hole, a second spring button hole, a third spring button hole, and a fourth spring button hole.

9. The device of claim 8, wherein said first spring buttonhole is used when the film roll is 24 inches; said second spring button hole is used when the film roll is 30 inches; said third spring button hole is used when the film roll is 36 inches; said fourth spring button hole is used when the film roil is 48 inches.

10. The device of claim 9, wherein said first fastener mechanism comprises a thumb screw disposed in said first elongated member; said thumb screw having a knob portion and an end portion engageable with said first extension member upon rotation of said knob portion.

11. The device of claim 10, wherein said handle is removably engaged with said first elongated member.

12. The device of claim 11, wherein said first and second elongated members are rectangular shaped.

13. The device of claim 12, wherein said first and second extension members are rectangular shaped.

14. The device of claim 13, wherein said first elongated member is welded to said second elongated member.

15. The device of claim 14, wherein said second end portion of said first extension member is welded to said right support assembly.

16. The device of claim 15, wherein said second end portion of said second extension member is welded to said left support assembly.

17. The device of claim 1, further comprising a pressing tube having first and second end portions; said right and left support assembly each comprise a film pressing roller adapted to support said first and second end portions of said pressing tube, respectively; said film pressing roller of said right support assembly has a length L1; said film mounting roller of said right support assembly has a length L2; said length L1 of said film pressing roller is greater than said length L2 of said film mounting roller; said film pressing roller of said left support assembly has a length L3; said film mounting roller of said left support assembly has a length L4; said length L3 of said film pressing roller is greater than said length L4 of said film mounting roll.

18. The device of claim 1, further comprising a pressing tube kit comprising first and second pressing tubes and a pressing tube assembly comprising third and fourth pressing tubes and an interconnect member; said right and left support assembly each comprise a film pressing roller adapted to support said first pressing tube; each of said film pressing rollers are further adapted to support said second pressing tube; each of said film pressing rollers are further adapted to support said pressing tube assembly; said third pressing tube having a first end portion engaged with said film pressing roller of said right support assembly and a second end portion engaged with said interconnect member; said fourth pressing tube having a first end portion engaged with said film pressing roller of said left support assembly and a second end portion removably engaged with said interconnect member; whereby said pressing kit may be used to provide film pressing tubes having lengths of 24 inches, 30 inches, 36 inches, and 48 inches while requiring a maximum packaging dimension of about 30 inches thereby reducing the size of a shipping box or container.

19. The device of claim 18, wherein said first pressing tube has a length of 24 inches; said second pressing tube has a length of 30 inches; said third pressing tube has a length of 18 inches; and said fourth pressing tube has a length of 18 inches.

* * * * *